252-99 AU 165 EX
7/20/76 XR 3,970,575

United States Patent [19]
Barrett, Jr.

[11] 3,970,575
[45] July 20, 1976

[54] LIQUID PEROXYGEN BLEACH

[75] Inventor: John H. Barrett, Jr., La Mirada, Calif.

[73] Assignee: Purex Corporation, Lakewood, Calif.

[22] Filed: Feb. 21, 1974

[21] Appl. No.: 444,466

[52] U.S. Cl. ..... 252/95; 252/DIG. 1; 252/DIG. 14; 252/99

[51] Int. Cl.[2] ..... C11D 3/40; C11D 7/54

[58] Field of Search ..... 252/95, DIG. 1, DIG. 14, 252/99

[56] References Cited

UNITED STATES PATENTS 3,058,916 10/1962 Sinner et al. ..... 252/95 X 3,577,347 5/1971 Monick ..... 252/99

OTHER PUBLICATIONS

"Tergitol S Surfactants for the Textile Industry," Union Carbide, 5/70, p. 26.

*Primary Examiner*—Mayer Weinblatt
*Attorney, Agent, or Firm*—White and Haefliger

[57] ABSTRACT

Composition for a clear blue colored, stabilized liquid peroxygen bleach, suitable for household laundry use on all fabrics, whose coloring dye is rendered non-substantive to natural or synthetic fibers by the inclusion of a non-ionic surfactant as an anti-dyeing agent having an HLB value within a predetermined range.

9 Claims, No Drawings

LIQUID PEROXYGEN BLEACH

BACKGROUND OF THE INVENTION

Stabilized liquid peroxygen bleaches based on hydrogen peroxide have been known for some time and employed on an industrial basis in the manufacture and finishing of fabrics. The usual form taken is that of stablized 35 percent hydrogen peroxide solutions. These are currently available from DuPont (Albone 35 CG) and from FMC (Standard 35% $H_2O_2$ or Super D 35%) $H_2O_2$). The adaptation of these industrial peroxygen bleaches to household use requires dilution to a lower strength, e.g. 6 percent, for safety and ease of use.

Consumer safety considerations make it desirable to color this type of product to clearly identify it as a nonpotable liquid. Pure hydrogen peroxide solutions are visually indistinguishable from water. A blue color is most desirable since, in common domestic usage, the color blue has come to connote a product intended for laundry use. A suitable blue dye must be both stable in the hydrogen peroxide without inducing bleach decomposition and not cause dyeing or staining of any known fiber of fabric likely to be laundered by a housewife.

Most commercially available, or otherwise known, blue dye systems are either degraded by, or cause breakdown of 6 percent hydrogen peroxide. Moreover, it is found that all blue dyes mutually stable with 6 percent hydrogen peroxide are strongly substantive to one or more common types of fibers when incorporated in a stabilized (acidic) liquid peroxygen bleach and used directly on a fabric.

SUMMARY OF THE INVENTION

The phthalocyanine blue pigments are among the most stable in hydrogen peroxide solutions. Their substantivity has presented the problem of discovering a way in which to prevent dye staining of any of the fabrics customarily laundered. In accordance with the invention it has been determined that the addition of small quantities of selected surface active agents will prevent dye substantivity of phthalocyanine based blue pigments.

The invention may be further summarized by the following formulation based on a commercially usable 1.0 to 8.0 percent hydrogen peroxide solution containing the dissolved surfactant and dispersed blue dye powder. All percentages herein are by weight.

- 1.0 to 8.0 percent hydrogen peroxide (35 percent stablilized liquid peroxide bleach diluted with deionized water),
- 0.5 to 10 percent non-ionic polyethylene oxide condensate surfactant having an HLB value from about 10 to 15,
- 0.0002 to 0.002 percent color stable phthalocyanine blue dye pigment powder.

In reference to the formula it may be mentioned that a preferred HLB value range is about 13–14 which tends to minimize the required surfactant concentration.

Dyes

Usable commercially available dyes are the phthalocyanine types categorized as "Pigment Blue 15" in the Colour Index, third edition, published by the AATCC and the Society of Dyers and Colourists. Available examples of this class which have been successfully used in this application are identified in the Colour Index as Heliogen Blue XW Pdr and Monastral Fast Blue BWD. Further reference to this class of dyes appear at pages 127, 3570 and 3571 of the Colour Index. Pertinent to the composition and production of phthalocyanine dyes are U.S. Pat. Nos. 2,216,761; 2,216,867; 2,216,868 and 2,452,606.

As commercially available the blue phthalocyanine dyes are of extremely small particle size approaching molecular dimensions so that the particles individually are not visually identifiable. However, in their dispersed state achieved by the invention they impart blue coloring to the aqueous peroxide solution, the color intensity being variable in accordance with the dye quantity used. The dye pigment concentration range recited above is found to be suitable for liquid household bleach.

HLB Values

It has been determined that within given classes of chemical compositions, effective surfactants may be identified by their HLB values.

The HLB concept is widely known and has been utilized for over twenty years by those skilled in the art when working with surface active agents. "HLB" stands for "hydrophile-lipophile balance" and serves to express on a numerical scale the relative behavior of a surfactant towards oil and towards water, as experimentally determined. The numerical scale is defined by arbitrarily assigning a value of 1.0 to oleic acid and a value of 20 to potassium oleate. While no theoretical basis exists for the HLB scale, a secondary method for predicting HLB values for nonionic surfactants is to divide by 5 the weight percent of the hydrophilic portion of the molecule. An important principle inherent in the HLB concept is that the HLB value of a mixture of surfactants will equal the weighted average of the HLB values of its individual component surfactants.

Literature references indicative of HLB value usages appear in Chemical Abstracts (CA) 70, 107540y; CA 68, 70210w; 73, 121738n; 74, 127324s; also in the following: p. 223 of 1971 issue of McCutcheon's Detergents and Emulsufiers; p. 18 "The Atlas HLB System" 2nd Edition (revised) 1963.

Surfactants

Usable surfactants in the stated 0.5 to 10 percent range include the following non-ionic polyethylene oxide condensates having collectively HLB value ranges from about 10 to 15.

A. Polyethylene oxide condensates of alkyl phenols having alkyl groups of at least 6 carbons, and usually about 8 to 12 carbons, whose HLB values are at least 10.5 but not more than 15.0. More narrowly preferred is Igepal CO-630, a nonylphenol with 9.5 moles of ethylene oxide whose HLB value is 13.9.

B. Polyethylene oxide condensates of aliphatic secondary alcohols having from 8 to 22 carbons whose HLB values are at least 12 but not more than 15. (e.g. Tergitol 15-S-9 consisting of $C_{11}$ to $C_{15}$ random secondary fatty alcohols with 9 moles of ethylene oxide, whose HLB value is 13.8.)

C. Polyethylene oxide condensates of linear primary aliphatic alcohols having from 8 to 22 carbons, whose HLB values are at least 11 but not more than 14. (e.g. Neodol 25-7, consisting of $C_{12}$ to $C_{15}$ linear primary alcohols with 7 moles of ethylene oxide, with an HLB value of 12.0.)

D. Polyethylene oxide condensates of polyoxypropylene glycols having molecular weights of at least 900, whose preferred HLB values are at least 10 but not more than 15. (e.g. Pluronic P-104, average molecular weight equals 5850, containing 40 percent ethylene oxide, with an HLB equaling 13.0.)

E. Polyethylene oxide ethers of aliphatic fatty alcohols having from 8 to 22 carbons, whose HLB values are at least 12 but not more than 15. (e.g. Brij 56, a polyoxyethylene cetyl ether whose HLB value is 12.9.)

F. Polyethylene oxide condensates of fatty acid partial esters of polyhydric alcohols, having more than 4 moles of polyoxyethylene and derived from fatty acids with 8 to 22 carbons, whose HLB values are at least 10 and not more than 15. (e.g. Tween 60, a polyoxyethylene sorbitan monostearate with 20 moles of ethylene oxide and whose HLB value is 14.9.)

As previously observed surfactants of different HLB values may be blended to obtain an intermediate desired HLB value even to the extent that two surfactants, of which one or both have an HLB value outside the effective range can be blended to an HLB value within the effective range to produce a satisfactory mixture.

The following is given as a preferred specific formulation, again base on diluted 35 percent stabilized liquid peroxide bleach:

6.0 percent hydrogen peroxide, 1.0 percent nonylphenol polyethylene oxide condensate surfactant having 9.5 moles of ethylene oxide and an HLB value of about 13.9 (GAF Corporation Igepal CO-630), 0.0005 percent phthalocyanine blue dye powder (Heliogen Blue WX Pdr, GAF), Deionized water q.s.

Any of the surfactants referred to in paragraph B to F above may be used in concentrations of about 1 percent in correspondence with the preferred specific formulation given above.

The following are further identifications of the Colour Index publication and manufactures of the products named in paragraph A to F in the foregoing.

The full name of the volume that lists Pigment Blue 15 is the Colour Index 3rd Edition and is published jointly by The American Association of Textile Chemists & Colorists and The Society of Dyers and Colourists.

The trade names and suppliers are listed below:

| | | |
|---|---|---|
| A. | Igepal | GAF Corporation |
| B. | Tergitol | Union Carbide Co. |
| C. | Neodal | Shell Chemical Co. |
| D. | Pluronic | BASF Wyandotte |
| E. | Brij | Atlas Powder Co. |
| F. | Tween | Atlas Powder Co. |

I claim:

1. An acidic stabilized aqueous bleach product consisting essentially of about:

a. 1.0 to 8.0 percent by weight stabilized hydrogen peroxide;

b. 0.5 to 10 percent by weight of a water soluble non-ionic surfactant which is a polyethylene oxide condensate having an HLB value from about 10 to 15, said condensate being of polyethylene oxide and a member from the group consisting of alkyl phenols having alkyl groups of 6 to 12 carbon atoms, secondary alcohols having from 8 to 22 carbons, linear primary alcohols having from 8 to 22 carbon atoms, polyoxypropylene glycols having molecular weights of at least 900, fatty alcohols having from 8 to 22 carbons, and fatty acid partial esters of polyhydric alcohols having at least 4 moles of polyoxyethylene and derived from fatty acids having from 8 to 28 carbons; and c. 0.0002 to 0.002 percent by weight color stable phthalocyanine blue dye pigment powder, said product having a clear blue appearance.

2. Product according to claim 1 in which said surfactant is a polyethylene oxide condensate of alkyl phenols having alkyl groups with 6 to 12 carbon atoms and whose HLB values are about 10.5 to 15.0.

3. Product according to claim 1 in which said surfactant is a polyethylene oxide condensate of secondary alcohols having from 8 to 22 carbons and whose HLB values are about 12 to 15.

4. Product according to claim 1 in which said surfactant consists of polyethylene oxide ethers of fatty alcohols having from 8 to 22 carbons and whose HLB values are from 12 to 15.

5. Product according to claim 1 in which said HLB value is about 13 to 14.

6. Product according to claim 2 in which said essential components are about:

6.0 percent hydrogen peroxide 1.0 percent nonylphenol polyethylene oxide condensate surfactant having 9.5 moles of ethylene oxide and an HLB value of about 13.9, and about 0.0005 percent phthalocyanine blue dye powder.

7. Product according to claim 3 in which said surfactant is a polyethylene oxide condensate of linear primary alcohols having from 8 to 22 carbon atoms and whose HLB values are about 11 to 14.

8. Product according to claim 3 in which said surfactant is a polyethylene oxide condensate of polyoxypropylene glycols having molecular weights of at least 900 and whose HLB values are about 10 to 15.

9. Product according to claim 4 in which said surfactant consists of polyethylene oxide condensates of fatty acid partial esters of polyhydric alcohols, having more than 4 moles of polyoxyethylene and derived from fatty acids having 8 to 28 carbons and whose HLB value is from 10 to 15.

* * * * *